US008211609B2

(12) United States Patent
Mang et al.

(10) Patent No.: US 8,211,609 B2
(45) Date of Patent: Jul. 3, 2012

(54) TONER COMPOSITIONS

(75) Inventors: Mark E. Mang, Rochester, NY (US); Timothy L. Lincoln, Rochester, NY (US); Yuhua Tong, Webster, NY (US); Kevin F. Marcell, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 1234 days.

(21) Appl. No.: 11/939,600

(22) Filed: Nov. 14, 2007

(65) Prior Publication Data

US 2009/0123862 A1 May 14, 2009

(51) Int. Cl.
*G03G 9/087* (2006.01)

(52) U.S. Cl. ..... 430/109.4; 430/137.18

(58) Field of Classification Search ..... 430/109.4, 430/137.18, 137.2

See application file for complete search history.

(56) References Cited

U.S. PATENT DOCUMENTS

| | | | | |
|---|---|---|---|---|
| 3,590,000 | A | 6/1971 | Palermiti et al. | |
| 4,797,339 | A | 1/1989 | Maruyama et al. | |
| 4,952,477 | A | 8/1990 | Fuller et al. | |
| 4,983,488 | A | 1/1991 | Tan et al. | |
| 4,990,424 | A | 2/1991 | Van Dusen et al. | |
| 4,996,127 | A | 2/1991 | Hasegawa et al. | |
| 5,057,392 | A | 10/1991 | McCabe et al. | |
| 5,166,026 | A | 11/1992 | Fuller et al. | |
| 5,227,460 | A | 7/1993 | Mahabadi et al. | |
| 5,364,729 | A | 11/1994 | Kmiecik-Lawrynowicz et al. | |
| 5,403,693 | A | 4/1995 | Patel et al. | |
| 5,866,290 | A | 2/1999 | Sacripante et al. | |
| 5,888,691 | A | 3/1999 | Laing et al. | |
| 6,017,671 | A | 1/2000 | Sacripante et al. | |
| 6,080,519 | A * | 6/2000 | Ishiyama et al. | 430/110.3 |
| 6,359,105 | B1 | 3/2002 | Ianni et al. | |
| 6,830,860 | B2 * | 12/2004 | Sacripante et al. | 430/109.3 |
| 6,835,518 | B2 | 12/2004 | Tachi et al. | |
| 7,001,702 | B2 | 2/2006 | Cheng et al. | |
| 7,183,361 | B2 | 2/2007 | Toman | |
| 7,208,252 | B2 | 4/2007 | Grande et al. | |
| 7,232,636 | B2 | 6/2007 | Semura et al. | |
| 7,335,453 | B2 * | 2/2008 | Sacripante et al. | 430/108.4 |
| 7,749,673 | B2 * | 7/2010 | Zhou et al. | 430/137.14 |
| 7,767,376 | B2 * | 8/2010 | Mang et al. | 430/137.18 |
| 7,833,688 | B2 * | 11/2010 | Mang et al. | 430/137.2 |
| 2006/0051686 | A1 * | 3/2006 | Ide et al. | 430/18 |
| 2006/0057488 | A1 * | 3/2006 | Inoue et al. | 430/109.4 |
| 2006/0216625 | A1 | 9/2006 | Maehata et al. | |
| 2006/0216626 | A1 | 9/2006 | Sacripante et al. | |
| 2007/0141496 | A1 | 6/2007 | Vanbesien et al. | |
| 2007/0207401 | A1 * | 9/2007 | Shirai | 430/109.4 |
| 2007/0224532 | A1 | 9/2007 | Vanbesien et al. | |
| 2007/0254228 | A1 | 11/2007 | Farrugia et al. | |
| 2008/0044753 | A1 * | 2/2008 | Hirota | 430/109.1 |

FOREIGN PATENT DOCUMENTS

| | | | |
|---|---|---|---|
| WO | WO 2005/103833 | A1 * | 11/2005 |
| WO | WO 2005/111730 | A1 * | 11/2005 |

OTHER PUBLICATIONS

Japanese Patent Office English-language abstract describing JP 2006-065015 A (pub. Mar. 2006).*
American Chemical Society (ACS) File Registry No. 871-70-5 on STN, copyright 2011, which was entered in STN on Nov. 16, 1984.*
American Chemical Society (ACS) File Registry No. 693-23-2 on STN, copyright 2011, which was entered in STN on Nov. 16, 1984.*
American Chemical Society (ACS) File Registry No. 505-54-4 on STN, copyright 2011, which was entered in STN on Nov. 16, 1984.*
American Chemical Society (ACS) File Registry No. 2424-92-2 on STN, copyright 2011, which was entered in STN on Nov. 16, 1984.*

* cited by examiner

*Primary Examiner* — Janis L Dote
(74) *Attorney, Agent, or Firm* — MDIP LLC

(57) ABSTRACT

The present disclosure provides toners including amorphous resins and crystalline resins. Toners with high glass transition temperatures and little plasticization may be obtained in accordance with the present disclosure.

16 Claims, No Drawings

TONER COMPOSITIONS

BACKGROUND

The present disclosure relates to processes useful in providing toners suitable for electrostatographic apparatuses, including xerographic apparatuses such as digital, image-on-image, and similar apparatuses.

Numerous processes are known for the preparation of toners, such as, for example, conventional processes wherein a resin is melt kneaded or extruded with a pigment, micronized and pulverized to provide toner particles. There are illustrated in U.S. Pat. Nos. 5,364,729 and 5,403,693, the disclosures of each of which are hereby incorporated by reference in their entirety, methods of preparing toner particles by blending together latexes with pigment particles. Also relevant are U.S. Pat. Nos. 4,996,127, 4,797,339 and 4,983,488, and U.S. Patent Application Publication Nos. 2007/0254228, 2007/0224532 and 2007/0141496, the disclosures of each of which are hereby incorporated by reference in their entirety.

Toner systems normally fall into two classes: two component systems, in which the developer material includes magnetic carrier granules having toner particles adhering triboelectrically thereto; and single component systems (SDC), which typically use only toner. Placing charge on the particles, to enable movement and development of images via electric fields, is most often accomplished with triboelectricity. Triboelectric charging may occur either by mixing the toner with larger carrier beads in a two component development system or by rubbing the toner between a blade and donor roll in a single component system. Toners should also display acceptable triboelectric properties, which may vary with the type of carrier or developer composition.

Toners useful for xerographic applications should possess certain properties relating to storage stability and particle size integrity. That is, the particles should remain intact and not agglomerate until they are fused on paper. Due to energy conservation measures, and more stringent energy characteristics placed on xerographic engines, such as on xerographic fusers, it may be desirable to reduce the fixing temperatures of toners onto paper, thereby reducing power consumption and extending the lifetime of the fuser system.

For a contact fuser, that is, a fuser which is in contact with the paper and the image, the toner should not substantially transfer or offset onto the fuser roller, referred to as hot or cold offset depending on whether the temperature is below the fixing temperature of the paper (cold offset), or whether the toner offsets onto a fuser roller at a temperature above the fixing temperature of the toner (hot offset).

Toners that may be used at desirable fusing temperatures, possessing properties including excellent document offset and heat cohesion, remain desirable.

SUMMARY

The present disclosure provides toners including amorphous resins and crystalline resins. Toners with high glass transition temperatures and little plasticization may be obtained in accordance with the present disclosure.

In embodiments, a process of the present disclosure may include contacting at least one diol having from about 2 carbon atoms to about 64 carbon atoms, with at least one diacid having from about 2 carbon atoms to about 64 carbon atoms to obtain a crystalline resin, and melt-mixing the crystalline resin, an amorphous resin, an optional wax, and an optional colorant to form a toner.

In other embodiments, a process of the present disclosure may include contacting at least one diol such as 1,2-octanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, 1,14-eicosanedecanediol, and combinations thereof, with at least one diacid such as pimelic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, 1,18-octadecanedicarboxylic acid, fumaric acid, succinic acid, 1,1-cyclobutanedicarboxylic acid, adipic acid, and combinations thereof to form a crystalline resin, melt-mixing the crystalline resin, an amorphous resin, an optional wax, and an optional colorant to form a toner, pelletizing the toner to form toner pellets, processing the toner pellets to form toner particles, and recovering the resulting toner particles.

A toner of the present disclosure may include a crystalline resin including at least one diol having from about 2 carbon atoms to about 64 carbon atoms, and at least one diacid having from about 2 carbon atoms to about 64 carbon atoms, an amorphous resin, an optional wax, and a colorant.

DETAILED DESCRIPTION OF EMBODIMENTS

The present disclosure provides toners having excellent processing characteristics. In embodiments, toners of the present disclosure may have high glass transition temperatures (Tg) with low plasticization. While any toner may be produced in accordance with the methods herein, in embodiments a toner may be produced by conventional melt-mixing and grinding methods and may include a binder including an amorphous polymeric resin and a crystalline resin, in combination with a suitable colorant. In embodiments, release agents such as waxes may also be added.

Examples of amorphous polymeric resins suitable for use in a toner herein include polyester resins, branched polyester resins, partially crosslinked polyester resins, polyimide resins, branched polyimide resins, poly(styrene-acrylate) resins, crosslinked poly(styrene-acrylate) resins, poly(styrene-methacrylate) resins, crosslinked poly(styrene-methacrylate) resins, poly(styrene-butadiene) resins, crosslinked poly(styrene-butadiene) resins, alkali sulfonated-polyester resins, alkali sulfonated-polyimide resins, alkali sulfonated poly (styrene-acrylate) resins, crosslinked alkali sulfonated poly (styrene-acrylate) resins, poly(styrene-methacrylate) resins, crosslinked alkali sulfonated-poly(styrene-methacrylate) resins, alkali sulfonated-poly(styrene-butadiene) resins, crosslinked alkali sulfonated poly(styrene-butadiene) resins, combinations thereof, and the like.

In embodiments, the amorphous polymeric resin may be an amorphous polyester, which may be a homopolymer or copolymer of two or more monomers. Suitable polyesters include, in embodiments, those derived from a dicarboxylic acid and a diphenol. Examples of such resins include those disclosed in U.S. Pat. No. 3,590,000, the disclosure of which is hereby incorporated by reference in its entirety. Suitable amorphous polyester materials also include those commercially available as GTUF and FPESL-2 from Kao Corporation, Japan, and EM181635 from Reichhold, Research Triangle Park, N.C., and the like.

In embodiments, the amorphous polyester may be obtained from the reaction of bisphenol A and propylene oxide or propylene carbonate, followed by the reaction of the resulting product with fumaric acid (see U.S. Pat. No. 5,227,460, the disclosure of which is hereby incorporated by reference in its entirety). For example, the amorphous polyester can include a polypropoxylated bisphenol A fumarate polyester. This resin may be used in a linear form, or partially crosslinked as described in U.S. Pat. No. 6,359,105, the disclosure of which is hereby incorporated by reference in its entirety. In embodiments, a blend of a linear resin and a partially crosslinked resin may be used to adjust the rheology of the resulting toner.

Branched amorphous resins which may be utilized in embodiments of the present disclosure include branched polyesters, branched polyamides, branched polyimides, branched polystyrene-acrylates, branched polystyrene-methacrylates, branched polystyrene-butadienes, or branched polyester-imides, branched alkali sulfonated polyesters, branched alkali sulfonated polyamides, branched alkali sulfonated polyimides, branched alkali sulfonated polystyrene-acrylates, branched alkali sulfonated polystyrene-methacrylates, branched alkali sulfonated polystyrene-butadienes, or branched alkali sulfonated polyester-imides, branched sulfonated polyester resins, branched copoly(ethylene-terephthalate)-copoly(ethylene-5-sulfo-isophthalate), branched copoly(propylene-terephthalate)-copoly(propylene-5-sulfo-isophthalate), branched copoly(diethylene-terephthalate)-copoly(diethylene-5-sulfo-isophthalate), branched copoly (propylene-diethylene-terephthalate)-copoly(propylene-diethylene-5-sulfo-isophthalate), branched copoly (propylene-butylene-terephthalate)-copoly(propylene-butylene-5-sulfo-isophthalate), branched copoly (propoxylated bisphenol-A-fumarate)-copoly (propoxylated bisphenol A-5-sulfo-isophthalate), branched copoly(ethoxylated bisphenol-A-fumarate)-copoly(ethoxylated bisphenol-A-5-sulfo-isophthalate), or branched copoly(ethoxylated bisphenol-A-maleate)copoly(ethoxylated bisphenol-A-5-sulfo-isophthalate), combinations thereof, and the like.

In embodiments, where utilized, the branched amorphous polyester resin may be prepared by the polycondensation of an organic diol, a diacid or diester, an optional sulfonated difunctional monomer, and a multivalent polyacid or polyol as the branching agent and a polycondensation catalyst.

Examples of diacids and/or diesters which may be selected for the preparation of amorphous polyesters include dicarboxylic acids or diesters such as terephthalic acid, phthalic acid, isophthalic acid, fumaric acid, maleic acid, succinic acid, itaconic acid, succinic acid, succinic anhydride, dodecylsuccinic acid, dodecylsuccinic anhydride, glutaric acid, glutaric anhydride, adipic acid, pimelic acid, suberic acid, azelaic acid, dodecanediacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, combinations thereof, and the like. The organic diacid or diester may be present, for example, in an amount from about 45 to about 52 mole percent of the resin.

Examples of diols which may be utilized in generating the amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hyroxyethyl)-bisphenol A, bis(2-hyroxypropyl)-bisphenol A, 1,4-cyclohexanedimethanol, 1,3-cyclohexanedimethanol, xylenedimethanol, cyclohexanediol, diethylene glycol, bis (2-hydroxyethyl) oxide, dipropylene glycol, dibutylene, combinations thereof, and the like. The amount of organic diol selected can vary, and be present, for example, in an amount from about 45 to about 52 mole percent of the resin.

Suitable alkali sulfonated difunctional monomers which may be utilized in forming an amorphous polyester resin include, where the alkali is lithium, sodium or potassium, dimethyl-5-sulfo-isophthalate, dialkyl-5-sulfo-isophthalate-4-sulfo-1,8-naphthalic anhydride, 4-sulfo-phthalic acid, 4-sulfophenyl-3,5-dicarbomethoxybenzene, 6-sulfo-2-naphthyl-3,5-dicarbomethoxybenzene, sulfo-terephthalic acid, dimethyl-sulfo-terephthalate, dialkyl-sulfo-terephthalate, sulfo-ethanediol, 2-sulfo-propanediol, 2-sulfo-butanediol, 3-sulfo-pentanediol, 2-sulfo-hexanediol, 3-sulfo-2-methylpentanediol, N,N-bis(2-hydroxyethyl)-2-aminoethane sulfonate, 2-sulfo-3,3-dimethylpentanediol, sulfo-p-hydroxybenzoic acid, combinations thereof, and the like. Effective difunctional monomer amounts of, for example, from about 0.1 to about 2 weight percent of the resin can be utilized.

Branching agents which may be utilized to generate a branched amorphous polyester resin include, for example, a multivalent polyacid such as 1,2,4-benzene-tricarboxylic acid, 1,2,4-cyclohexanetricarboxylic acid, 2,5,7-naphthalenetricarboxylic acid, 1,2,4-naphthalenetricarboxylic acid, 1,2,5-hexanetricarboxylic acid, 1,3-dicarboxyl-2-methyl-2-methylene-carboxylpropane, tetra(methylene-carboxyl) methane, and 1,2,7,8-octanetetracarboxylic acid, acid anhydrides thereof, and lower alkyl esters thereof, for example, those possessing from about 1 to about 6 carbon atoms; a multivalent polyol such as sorbitol, 1,2,3,6-hexanetetrol, 1,4-sorbitane, pentaerythritol, dipentaerythritol, tripentaerythritol, sucrose, 1,2,4-butanetriol, 1,2,5-pentatriol, glycerol, 2-methylpropanetriol, 2-methyl-1,2,4-butanetriol, trimethylolethane, trimethylolpropane, 1,3,5-trihydroxymethylbenzene, combinations thereof, and the like.

The amorphous polyester may have a glass transition temperature of from about 50° C. to about 65° C., in embodiments from about 54° C. to about 62° C.

A crystalline resin which may be utilized in forming a toner may include, for example, a polyester, a polyamide, a polyimide, a polyolefin such as a polyethylene, a polypropylene, a polybutylene or an ethylene-propylene copolymer, a polyisobutyrate, an ethylene-vinyl acetate copolymer, combinations thereof, and the like.

In embodiments, the crystalline polyester material may be derived from a monomer system including a diol and a diacid such as a dicarboxylic acid. Suitable diols which may be utilized in forming such crystalline polyesters may have from about 2 carbon atoms to about 64 carbon atoms, in embodiments from about 4 carbon atoms to about 32 carbon atoms, in embodiments from about 8 to about 12 carbon atoms. Examples of suitable diols include, but are not limited to, 1,2-octanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, 1,14-eicosanedecanediol, and/or combinations thereof.

Suitable dicarboxylic acids which may be utilized in forming such crystalline polyesters may have from about 2 carbon atoms to about 64 carbons atoms, in embodiments from about 4 carbon atoms to about 32 carbon atoms, in embodiments from about 8 to about 12 carbon atoms. Examples of suitable dicarboxylic acids include, but are not limited to, pimelic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, 1,18-octadecanedicarboxylic acid, fumaric acid, succinic acid, 1,1-cyclobutanedicarboxylic acid, adipic acid, and/or combinations thereof.

Examples of suitable crystalline resins include, but are not limited to, poly(1,10-decamethylene sebacate), poly(1,9-nonyl dodecanoate), poly(1,9-nonyl sebacate), poly(1,6-hexamethylene sebacate), poly(1,12-dodecamethylene dodecanoate), poly(1,4-butylene dodecanoate), combinations thereof, and the like. For example, in embodiments the crystalline polyester may be derived from a 10 carbon diol such as 1,10-decanediol and an 8 carbon dicarboxylic acid such as suberic acid.

The diol may be present in an amount of, for example, from about 20 to about 80 mole percent of the crystalline resin, in embodiments from about 45 to about 50 mole percent of the crystalline resin. The diacid may thus be present in an amount of, for example, from about 80 to about 20 mole percent of the crystalline resin, in embodiments from about 50 to about 55 mole percent of the crystalline resin.

The crystalline polyester may have a melting point of from about 65° C. to about 125° C., in embodiments from about 70° C. to about 115° C.

The crystalline resin may be prepared by a polycondensation process of reacting a diol and a dicarboxylic acid in the presence of a polycondensation catalyst. In embodiments, a stoichiometric equimolar ratio of diol and dicarboxylic acid may be utilized. However, in some instances, where the boiling point of the diol is from about 180° C. to about 230° C., an excess amount of diol can be utilized and removed during the polycondensation process.

The amount of catalyst utilized may vary, and can be selected in an amount, for example, of from about 0.001 to about 5 mole percent of the resin.

Catalysts may also be utilized in the production of amorphous polyesters.

Suitable polycondensation catalysts for production of either the crystalline or amorphous polyesters include tetraalkyl titanates, dialkyltin oxide such as dibutyltin oxide, tetraalkyltin such as dibutyltin dilaurate, dialkyltin oxide hydroxide such as butyltin oxide hydroxide, aluminum alkoxides, alkyl zinc, dialkyl zinc, zinc oxide, stannous oxide, or combinations thereof. Catalysts may be utilized in amounts of, for example, from about 0.001 mole percent to about 5 mole percent based on the starting diacid or diester used to generate the polyester resin, in embodiments from about 0.01 to about 2 mole percent of the resin based on the starting diacid or diester used to generate the polyester resin.

The amorphous resin and crystalline resin may be combined to form a binder resin which, in turn, may be utilized to form a toner. The amorphous resin may be present in an amount from about 10 to about 90 percent by weight of the combination of amorphous resin and crystalline resin (i.e., the binder resin), in embodiments from about 65 to about 85 percent by weight of the binder resin. Thus, the crystalline resin may be present in an amount from about 90 to about 10 percent by weight of the combination of the binder resin, in embodiments from about 35 to about 15 percent by weight of the binder resin.

The addition of a crystalline polyester to an amorphous polyester in forming the binder resin may result in a suppression of the glass transition temperature (Tg) of the toner, sometimes referred to herein, in embodiments, as plasticization. Plasticization may not be desirable because if the Tg is too low for a toner, there may be problems in storage, for example blocking, and usage of the toner at elevated temperatures.

In accordance with the present disclosure, it has been surprisingly found that the use of diols having from about 2 carbon atoms to about 64 carbon atoms, in embodiments from about 4 carbon atoms to about 32 carbon atoms, in other embodiments from about 8 carbon atoms to about 12 carbon atoms, in the formation of a crystalline polyester and diacids having from about 2 carbon atoms to about 64 carbon atoms, in embodiments from about 4 carbon atoms to about 32 carbon atoms, in other embodiments from about 8 carbon atoms to about 12 carbon atoms, result in the formation of a crystalline polyester that is less likely to plasticize the amorphous polyester when combined therewith in the toner formation process, as compared with crystalline polyesters synthesized from diols and diacids having lower carbon numbers.

Toners of the present disclosure may also include a colorant. The colorant in the toner can be a pigment, dye, combinations thereof, and the like. Suitable colorants include, for example, carbon black like REGAL 330® magnetites, such as Mobay magnetites M08029™, M08060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like. As colored pigments, there can be selected cyan, magenta, yellow, red, green, brown, blue or mixtures thereof. Specific examples of pigments include phthalocyanine HELIOGEN BLUE L6900™, D6840™, D7080™, D7020™, PYLAM OIL BLUE™, PYLAM OIL YELLOW™, PIGMENT BLUE 1™ available from Paul Ulhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours & Company, and the like. Generally, colorants that can be selected are black, cyan, magenta, or yellow, and mixtures thereof. Examples of magentas are 2,9-dimethyl-substituted quinacridone and anthraquinone dye identified in the Color Index as CI-60710, CI Dispersed Red 15, diazo dye identified in the Color Index as CI-26050, CI Solvent Red 19, and the like. Illustrative examples of cyans include copper tetra(octadecyl sulfonamido) phthalocyanine, x-copper phthalocyanine pigment listed in the Color Index as CI-74160, CI Pigment Blue, and Anthrathrene Blue, identified in the Color Index as CI 69810, Special Blue X-2137, and the like; while illustrative examples of yellows are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as colorants. Other known colorants can be selected, such as LEVANYL® Black A-SF (Miles, Bayer) and SUNSPERSE® Carbon Black LHD 9303 (Sun Chemicals), and colored dyes such as NEOPEN® Blue (BASF), SUDAN® Blue OS (BASF), PV Fast Blue B2G01 (American Hoechst), SUNSPERSE® Blue BHD 6000 (Sun Chemicals), IRGALITE® Blue BCA (Ciba-Geigy), PALIOGEN® Blue 6470 (BASF), SUDAN® III (Matheson, Coleman, Bell), SUDAN® II (Matheson, Coleman, Bell), SUDAN® IV (Matheson, Coleman, Bell), SUDAN® Orange G (Aldrich), SUDAN® Orange 220 (BASF), PALIOGEN® Orange 3040 (BASF), Ortho Orange OR 2673 (Paul Uhlich), PALIOGEN® Yellow 152, 1560 (BASF), LITHOL® Fast Yellow 0991K (BASF), PALIOTOL® Yellow 1840 (BASF), NEOPEN® Yellow (BASF), NOVOPERM® Yellow FG 1 (Hoechst), Permanent Yellow YE 0305 (Paul Uhlich), LUMOGEN® Yellow D0790 (BASF), SUNSPERSE® Yellow YHD 6001 (Sun Chemicals), SUCO-GELB® L1250

(BASF), SUCO-YELLOW® D1355 (BASF), HOSTAPERM® Pink E (American Hoechst), FANAL® Pink D4830 (BASF), CINQUASIA® Magenta (DuPont), LITHOL® Scarlet D3700 (BASF), Toluidine Red (Aldrich), Scarlet for THERMOPLAST® NSD PS PA (Ugine Kuhlmann of Canada), E.D. Toluidine Red (Aldrich), LITHOL® Rubine Toner (Paul Uhlich), LITHOL® Scarlet 4440 (BASF), Bon Red C (Dominion Color Company), Royal Brilliant Red RD-8192 (Paul Uhlich), ORACET® Pink RF (Ciba-Geigy), PALIOGEN® Red 3871K (BASF), PALIOGEN® Red 3340 (BASF), and LITHOL® Fast Scarlet L4300 (BASF).

Optionally, a toner of the present disclosure may include a wax. A wax can be present in an amount of from about 4 to about 12 percent by weight of the toner particles, in embodiments from about 6 to about 10 percent by weight of the toner particles. Examples of waxes, if present, include natural waxes like carnauba, fisher-tropsch waxes, polypropylene waxes, and polyethylene waxes commercially available from Allied Chemical and Baker Petrolite Corporation, EPOLENE N-15™ commercially available from Eastman Chemical Products, Inc., VISCOL 550-P™, a low weight average molecular weight polypropylene available from Sanyo Kasei K.K., and similar materials. The commercially available polyethylenes selected usually possess a molecular weight of from about 1,000 to about 1,500, while the commercially available polypropylenes utilized for the toner compositions of the present invention are believed to have a molecular weight of from about 4,000 to about 5,000. Examples of functionalized waxes include amines, amides, imides, esters, quaternary amines, carboxylic acids or acrylic polymer emulsion, for example JONCRYL™ 74, 89, 130, 537, and 538, all available from SC Johnson Wax, chlorinated polypropylenes and polyethylenes commercially available from Allied Chemical and Petrolite Corporation and SC Johnson wax. Combinations of the foregoing waxes may be utilized in embodiments.

Toners of the present disclosure may be formed by any method within the purview of those skilled in the art. Suitable methods, include, but are not limited to, melt mixing, and the like. In embodiments, toners of the present disclosure may be formed by melt mixing utilizing methods and apparatus within the purview of those skilled in the art. For example, melt mixing of the toner ingredients can be accomplished by physically mixing or blending the toner ingredients, including the amorphous resin, crystalline resin, optional colorant, optional wax, and any other additive, and then melt mixing, for example, in an extruder or a BANBURY®/two roll mill apparatus. Suitable temperatures may be applied to the extruder or similar apparatus, for example from about 65° C. to about 200° C., in embodiments from about 80° C. to about 120° C.

The components of the toner, including the amorphous resin, the crystalline resin, wax, if any, colorant, and other additives, if any, may be combined so that the toner extrudate has the desired composition of colorants and additives. The toner extrudate may then, in embodiments, be divided into a pellet or rough crushed form, sometimes referred to herein as "pelletizing," utilizing methods within the purview of those skilled in the art, for example, by pelletizers, fitzmilling, pinmilling, grinders, classifiers, additive blenders, screeners, combinations thereof, and the like. As used herein, "pelletizing" may include any process within the purview of those skilled in the art which may be utilized to form the toner extrudate into pellets, a rough crushed form, or coarse particles, and "pellets" include toner extrudate divided into pellet form, rough crushed form, coarse particles, or any other similar form.

In embodiments the toner may be treated to further reduce plasticization. For example, in embodiments, the toner may be subjected to an annealing step. This annealing step may occur by introducing toner pellets produced after melt-mixing into a heating device, in embodiments an oven, a rotary kiln, a fluidized bed dryer, combinations thereof, and the like, where the toner is heated to a temperature above its Tg. Suitable devices for annealing the toners may be readily constructed or obtained from commercial sources including, for example, rotary kilns from Harper Corporation.

In embodiments, heating the toner to a temperature above its Tg, sometimes referred to herein, in embodiments, as annealing, may allow the polymer system of the binder resin to relax, thereby permitting the crystalline domains of the crystalline polyester component of the binder to recrystallize. This recrystallization will increase the Tg of the toner, thereby avoiding the storage and usage problems which may otherwise occur with a toner having a low Tg.

Where the toner particles or pellets are subjected to annealing, they may be cooled to a temperature below the toner Tg, in embodiments at a temperature of from about 20° C. to about 24° C.

In embodiments, regardless of whether or not the toner particles are subjected to an annealing step, the resulting toner particles may possess a glass transition temperature of from about 38° C. to about 65° C., in embodiments from about 39° C. to about 57° C.

The binder resin, including the amorphous and crystalline resins described above, may be present in the resulting toner in an amount from about 50 weight percent to about 99 weight percent of the toner composition, in embodiments from about 70 weight percent to about 97 weight percent of the toner composition, with the colorant being present in an amount from about 1 to about 50 weight percent of the toner composition, in embodiments from about 3 to about 30 weight percent of the toner composition.

The resulting toner pellets may then be subjected to grinding utilizing, for example, an Alpine AFG fluid bed grinder, or Sturtevant micronizer, for the purpose of achieving toner particles with a volume median diameter of less than about 25 microns, in embodiments from about 5 microns to about 15 microns, in other embodiments from about 5.5 microns to about 12 microns, which diameters can be determined by a Multisizer II from Beckman Coulter. Subsequently, the toner compositions can be classified utilizing, for example, a Donaldson Model B classifier for the purpose of removing toner fines, that is, toner particles less than about 5 microns volume median diameter to obtain toner particles.

The resulting particles can possess an average volume particle diameter of about 5 microns to about 15 microns, in embodiments from about 5.5 microns to about 12 microns.

As would be apparent to one skilled in the art, the maximum value for the glass transition temperature may be dependent upon the amorphous resin. For example, if the amorphous resin has a glass transition temperature of 55° C., the maximum value the annealed toner could achieve is 55° C. Utilizing crystalline polyesters synthesized with diols having longer carbon chains and diacids having longer carbon chains surprisingly reduces plasticization and allows the glass transition temperature of the plasticized toner to increase toward the glass transition temperature of the original amorphous resin.

The following Examples are being submitted to illustrate embodiments of the present disclosure. These Examples are intended to be illustrative only and are not intended to limit the scope of the present disclosure. Also, parts and percentages are by weight unless otherwise indicated.

Example 1

A variety of crystalline polyesters of varying single unit chain length were synthesized. As used herein, a single unit means one diacid and one diol pair. The chain length was the number of carbon atoms in a continuous chain of the single unit. If aromatic or cyclic groups existed, the counting procedure is summarized in formula (I) below.

(I)

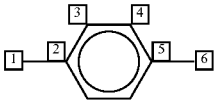

Thus, for the organic molecule depicted in formula (I) above, which has 8 total carbon atoms and possessing an aromatic group, the longest continuous chain was 6.

For the crystalline polyesters, the carbon chain of the diacid was from about 4 to about 10 and the carbon chain of the diol was from about 6 to about 10. The resulting single unit crystalline polyester thus had a carbon chain length of from about 10 to about 20.

Toners containing about 12.5% of each of the crystalline polyesters, about 17% of partially crosslinked bisphenol-A fumarate, and the balance a GTUFC-115 amorphous polyester resin commercially available from Kao Resins, Japan, were made for each sample on an APV model MP2015 twin-screw extruder available from APV Chemical Machines (Saginaw, Mich.). The operating conditions were a barrel temperature of about 120° C., a throughput rate of about 1.5 pounds/hour, and a screw speed of about 300 revolutions per minute (rpm). Colorant and wax were omitted for this study to ensure the modulated differential scanning calorimetry (MDSC) was only measuring resin properties, but in practice they may be added as needed. One toner was made for each of the different crystalline polyesters.

The resulting toners were submitted for modulated differential scanning calorimetry analysis to measure the glass transition temperature, or Tg, which indicated the degree of plasticization of the toner. Higher Tg values indicated less plasticization. Generally, the Tg was measured as follows. Approximately 10 mg of a sample was weighed into an aluminum pan and analyzed using a TA Instruments Q1000 utilizing the following temperature program:

Equilibrate at about 0° C.

Modulate +/−0.48° C. every 60 seconds

Isothermal for about 5 minutes

Ramp (increase) temperature about 3° C./minute to about 160° C.

Table 1 below shows the various crystalline polyesters utilized and the results obtained, including the increased Tg toner values obtained with the crystalline polyesters having longer chain lengths.

TABLE 1

| Crystalline polyester (# C in diacid/ # carbon in diol) | Single unit carbon chain length for crystalline polyester | Onset Tg° C. (Reversing Heat Flow) Average of 2 measurements |
|---|---|---|
| 12.5% C4/C6 | 10 | 39.4 |
| 12.5% C6/C6 | 12 | 40.3 |
| 12.5% C6/C8 | 14 | 44.65 |
| 12.5% C10/C6 | 16 | 48.6 |
| 12.5% C6/C10 | 16 | 53.05 |
| 12.5% C8/C10 | 18 | 56.15 |
| 12.5% C10/C10 | 20 | 56.45 |

As can be seen from Table 1, a longer carbon chain length in the crystalline polyester produced less of a plasticization effect on the amorphous resin at the same extrusion temperature and screw rpm. It can also be seen that toners were less plasticized because their Tg values increased. This lower degree of plasticization, as evidenced by the higher Tg, may avoid problems in storage, for example blocking, and usage of the toner at elevated temperatures.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. A process comprising:

contacting a diol having from about 2 carbon atoms to about 64 carbon atoms, with a diacid selected from the group consisting of pimelic acid, 1,9-nonanedicarboxylic acid, 1,10-decanedicarboxylic acid, 1,12-dodecanedicarboxylic acid, 1,14-tetradecanedicarboxylic acid, 1,18-octadecanedicarboxylic acid, 1,1-cyclobutanedicarboxylic acid, and combinations thereof to obtain a crystalline resin; and melt-mixing the crystalline resin, an amorphous resin, an optional wax, and a colorant to form a toner, wherein said toner has a glass transition temperature of from about 38° C. to about 65° C., and wherein said crystalline resin and said amorphous resin form a binder resin, and said crystalline resin is present in an amount from about 15 weight percent to about 35 weight percent of said binder resin.

2. A process in accordance with claim 1, wherein the diol is selected from the group consisting of 1,2-octanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, 1,14-eicosanedecanediol, and combinations thereof.

3. A process in accordance with claim 1, wherein the amorphous resin is selected from the group consisting of polyester resins, branched polyester resins, partially crosslinked polyester resins, and combinations thereof.

4. A process in accordance with claim 1, wherein said binder resin is present in the toner particles in an amount from about 50 weight percent to about 99 weight percent of the toner particles.

5. A process in accordance with claim 1, wherein the optional colorant comprises a pigment, dye, or combinations thereof present in an amount from about 1 to about 50 weight percent of the toner particles.

6. A process in accordance with claim 1, further comprising pelletizing the toner to form toner pellets, processing the toner pellets to form toner particles, and recovering the resulting toner particles.

7. A process in accordance with claim 6, wherein the toner particles possess a volume median diameter of from about 5 microns to about 15 microns.

8. A process comprising:

contacting a diol selected from the group consisting of 1,2-octanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecandediol, 1,14-tetradecanediol, 1,18-octadecanediol, 1,14-eicosanedecanediol, and combinations thereof, with a diacid selected from the group consisting of pimelic acid, 1,9-nonanedicarboxylic acid, 1,10-decanedicarboxylic acid, 1,12-dodecanedicarboxylic acid, 1,14-tetradecanedicarboxylic acid, 1,18-octadecanedicarboxylic acid, 1,1-cyclobutanedicarboxylic acid, and combinations thereof to form a crystalline resin;

melt-mixing the crystalline resin, an amorphous resin, an optional wax, and a colorant to form a toner;

pelletizing the toner to form toner pellets;

processing the toner pellets to form toner particles; and recovering the resulting toner particles, wherein said toner has a glass transition temperature of from about 38° C. to about 65° C., and wherein said crystalline resin and said amorphous resin form a binder resin, and said crystalline resin is present in an amount from about 15 weight percent to about 35 weight percent of said binder resin.

9. A process in accordance with claim 8, wherein the amorphous resin is selected from the group consisting of polyester resins, branched polyester resins, partially crosslinked polyester resins, and combinations thereof.

10. A process in accordance with claim 8, wherein said binder resin is present in the toner in an amount from about 70 weight percent to about 97 weight percent of the toner particles.

11. A process in accordance with claim 8, wherein the colorant comprises a pigment, dye, or combinations thereof present in an amount from about 3 to about 30 weight percent of the toner particles.

12. A process in accordance with claim 8, wherein the toner particles possess a volume diameter of from about 5.5 microns to about 12 microns.

13. A toner comprising:

a crystalline resin consisting of a diol selected from the group consisting of 1,2-octanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, 1,14-eicosanedecanediol and combinations thereof, and a diacid selected from the group consisting of pimelic acid, 1,9-nonanedicarboxylic acid, 1,10-decanedicarboxylic acid, 1,12-dodecanedicarboxylic acid, 1,14-tetradecanedicarboxylic acid, 1,18-octadecanedicarboxylic acid, 1,1-cyclobutanedicarboxylic acid and combinations thereof;

an amorphous resin;

an optional wax; and a colorant, wherein said toner has a glass transition temperature of from about 38° C. to about 65° C., and wherein said crystalline resin and amorphous resin form a binder resin, and said crystalline resin is present in an amount from about 15 weight percent to about 35 weight percent of said binder resin.

14. A toner in accordance with claim 13, wherein the amorphous resin is selected from the group consisting of polyester resins, branched polyester resins, partially crosslinked polyester resins, and combinations thereof.

15. A toner in accordance with claim 13, wherein said binder resin is present in the toner in an amount from about 50 weight percent to about 99 weight percent of the toner, and the colorant comprises a pigment, dye, or combinations thereof present in an amount from about 1 to about 50 weight percent of the toner.

16. A toner in accordance with claim 13, wherein the toner comprises particles possessing a volume median diameter of from about 5 microns to about 15 microns.

* * * * *